US005400628A

United States Patent [19]

Ryan

[11] Patent Number: 5,400,628

[45] Date of Patent: Mar. 28, 1995

[54] GUARD PLATE FOR LOCKS

[76] Inventor: Timothy Ryan, 5580 Broadway, Bronx, N.Y. 10463

[21] Appl. No.: 102,845

[22] Filed: Aug. 6, 1993

[51] Int. Cl.[6] ..... E05B 15/16

[52] U.S. Cl. ..... 70/417; 70/423; 70/452

[58] Field of Search ..... 70/416, 417, 423, 424, 70/448, 450–452, 455, 466

[56] References Cited

U.S. PATENT DOCUMENTS

| | | | |
|---|---|---|---|
| 3,343,386 | 9/1967 | Hall | 70/455 X |
| 3,844,144 | 10/1974 | Schmitt | 70/417 X |
| 3,899,907 | 8/1975 | Prahl | 70/451 X |
| 4,074,552 | 2/1978 | Smith | 70/417 |
| 4,160,368 | 7/1979 | Solow | 70/417 |
| 4,237,712 | 12/1980 | Cramer | 70/417 |
| 4,316,371 | 2/1982 | Del Nero | 70/417 |
| 4,466,264 | 8/1984 | Del Nero | 70/417 |
| 4,530,223 | 7/1985 | Oliver | 70/417 |
| 4,548,062 | 10/1985 | Kaufman | 70/417 |
| 4,638,652 | 1/1987 | Morse et al. | 70/455 X |
| 4,712,403 | 12/1987 | Markisello | 70/417 |
| 5,195,342 | 3/1993 | Werner | 70/417 |
| 5,267,461 | 12/1993 | Eizen | 70/418 X |

FOREIGN PATENT DOCUMENTS

| | | | |
|---|---|---|---|
| 385441 | 11/1923 | Germany | 70/423 |
| 1557457 | 12/1979 | United Kingdom | 70/417 |

*Primary Examiner*—Peter M. Cuomo
*Assistant Examiner*—Suzanne L. Dino

[57] ABSTRACT

A protective guard is provided for a lock cylinder in a door, which consists of a generally rectangular metal plate assembly having a central passageway therethrough. Components are for attaching the plate assembly to the door with the central passageway generally aligned with the lock cylinder. The attaching components are concealed, removable and adjustably connected to an inner side of the plate assembly, thereby rendering the lock cylinder less susceptible to tampering.

2 Claims, 1 Drawing Sheet

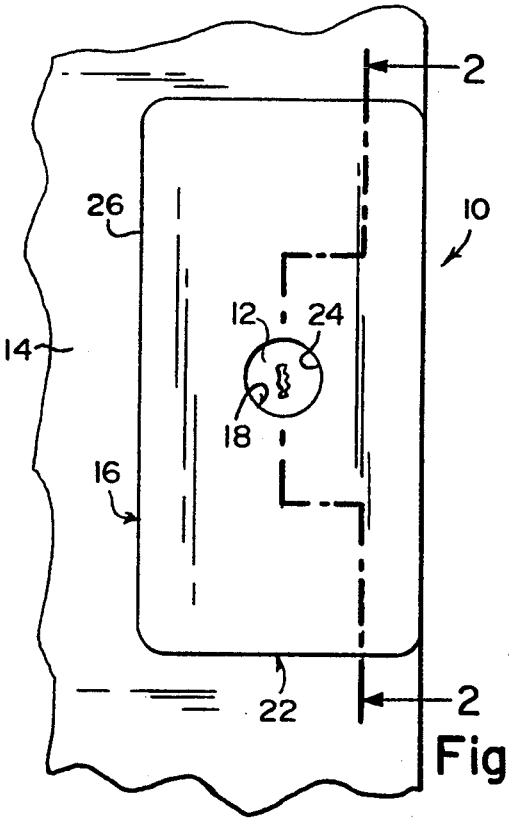
Fig. 1
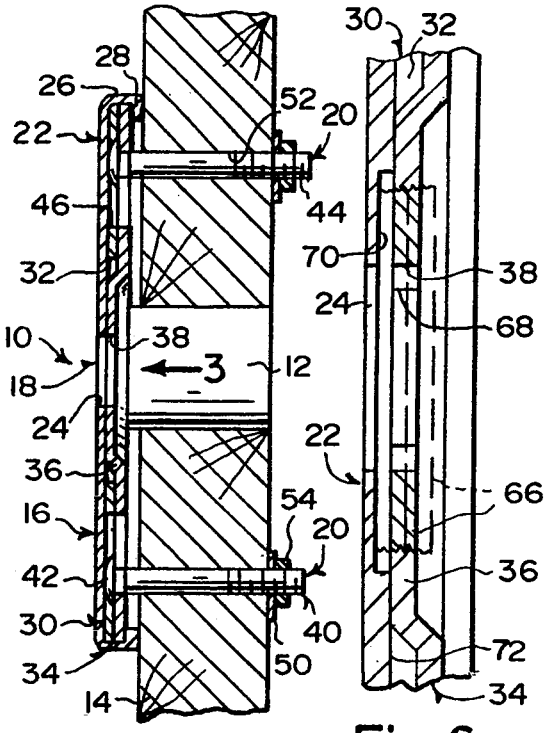
Fig. 2
Fig. 6
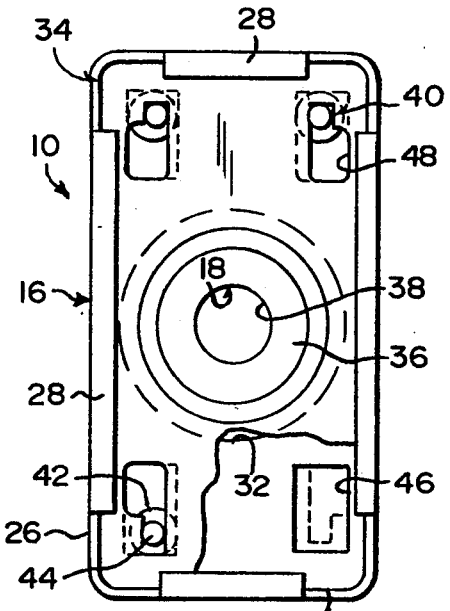
Fig. 3
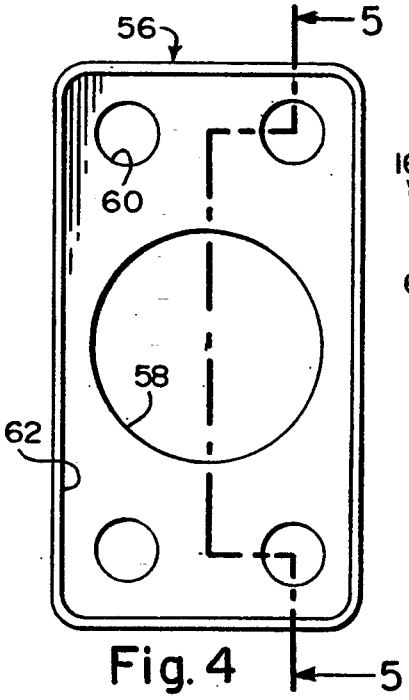
Fig. 4
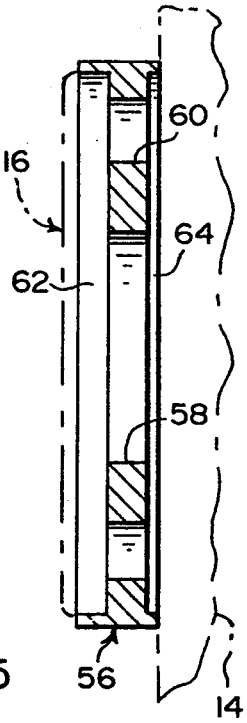
Fig. 5

GUARD PLATE FOR LOCKS

BACKGROUND OF THE INVENTION

The instant invention relates generally to devices for preventing the tampering of door locks and more specifically it relates to a protective guard for a lock cylinder in a door, which provides bolts that are concealed and adjustably connected on an inner side of the protective guard to mount the protective guard over the lock cylinder.

There are available various conventional devices for preventing the tampering of door locks which do not provide the novel improvements of the invention herein disclosed.

SUMMARY OF THE INVENTION

A primary object of the present invention is to provide a protective guard for a lock cylinder in a door that will overcome the shortcomings of the prior art devices.

Another object is to provide a protective guard for a lock cylinder in a door, wherein bolts which mount the protective guard over the lock cylinder are concealed and adjustably connected to an inner side of the protective guard.

An additional object is to provide a protective guard for a lock cylinder in a door, wherein the bolts are removable and changeable, so that different bolt sizes and lengths can be used.

A further object is to provide a protective guard for a lock cylinder in a door that is simple and easy to use.

A still further object is to provide a protective guard for a lock cylinder in a door that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 a front view of the instant invention attached to a door.

FIG. 2 is a cross sectional view taken along the line 2—2 of FIG. 1.

FIG. 3 is a rear view of the instant invention per se taken in the direction of arrow 3 in FIG. 2 with parts broken away.

FIG. 4 is an elevational view of the raising bracket.

FIG. 5 is a cross sectional view taken along the line 5—5 in FIG. 4.

FIG. 6 is an enlarged cross sectional view similar to FIG. 2 of a portion of a modification, showing an adjustable feature therein.

DETAILED DESCRIPTION OF THE PREFERRED EMBODIMENTS

Turning now descriptively to the drawings, in which similar reference characters denote similar elements throughout the several views, FIGS. 1 through 3 illustrate a protective guard 10 for a lock cylinder 12 in a door 14, which consists of a generally rectangular metal plate assembly 16, having a central passageway 18 therethrough and components 20 are for attaching the plate assembly 16 to the door 14 with the central passageway 18 generally aligned with the lock cylinder 12. The attaching components 20 are concealed, removable and adjustably connected to an inner side of the plate assembly 16, thereby rendering the lock cylinder 12 less susceptible to tampering.

The plate assembly 16 contains a cover plate 22, having a central aperture 24 and a peripheral edge 26, with bendable tangs 28. A first plate 30 has a large hole 32 concentric about the central aperture 24 in the cover plate 22, when the first plate 30 is inserted into the cover plate 22. A second plate 34 has a tapered recessed circular portion 36, with an orifice 38 therethrough concentric to the central aperture 24 in the cover 22 and the large hole 32 in the first plate 30. When the second plate 34 is inserted into the cover plate 22 against the first plate 30, the bendable tangs 28 are bent over to retain the first plate 30 and the second plate 34 within the cover plate 22.

The attaching components 20 includes a plurality of bolts 40 each having a round head 42 and a threaded shaft 44. The first plate 30 has a plurality of cavities 46 therein about the large hole 32. The second plate 34 has a plurality of large top slots 48, each in alignment with one cavity 46 in the first plate 30. Each round head 42 of each bolt 40 can be inserted into one large top slot 48 in the second plate 34, to enter one cavity 46 in the first plate 30 and slide into position therein, to be retained in a removable condition. A plurality of washers 50 are provided, with each to fit onto one threaded shaft 44, after the threaded shaft 44 is inserted and extends through a bore hole 52 in the door. A plurality of nuts 54 are also provided, with each threaded onto one threaded shaft 44 against one washer 50.

FIGS. 4 and 5 show a raising bracket 56, having a large central opening 58, a plurality of smaller holes 60 therethrough, a pair of opposite recessed areas 62, 64, one of which is deeper than the other. The plate assembly 16 can fit into either one of the recessed areas 62, 64 with the large central opening 58 in a general alignment with the central passageway 18 in the plate assembly 16. The smaller holes 60 are in general alignment with the threaded shafts 44 of the bolts 40 extending from the plate assembly 16, when the lock cylinder 12 extends further outwardly from the door 14.

A modification is shown in FIG. 5, in which the second plate 34 has a circular threaded plug member 66 concentrically located in the tapered recessed circular portion 36, with a tool receiving socket 68 in the orifice 38. The cover plate 22 has an annular seat 70, formed on an inner surface 72 concentrically about the central aperture 24. The seat 70 is of a larger diameter than the plug member 66, to allow for an adjustment setting of the plug member 66, with respect to the lock cylinder 12, which extends outwardly from the door 14.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A protective guard for a lock cylinder in a door which comprises:

a) a generally rectangular metal plate assembly having a central axial passageway therethrough;

b) means for attaching said plate assembly to the door with said central passageway generally axially aligned with the lock cylinder, whereby said attaching means is concealed, removable and laterally adjustably connected to an inner side of said plate assembly, thereby rendering the lock cylinder less susceptible to tampering in combination with a raising bracket having a large central opening, a plurality of smaller holes therethrough, a pair of opposite recessed areas one of which is deeper than the other, so that said plate assembly can fit into either one of said recessed areas.

2. A protective guard for a lock cylinder in a door which comprises:

a) a generally rectangular metal plate assembly having a central axial passageway therethrough;

b) means for attaching said plate assembly to the door with said central passageway generally axially aligned with the lock cylinder, whereby said attaching means is concealed, removable and laterally adjustably connected to an inner side of said plate assembly, thereby rendering the lock cylinder less susceptible to tampering; wherein said plate assembly includes:

c) a cover plate having a central aperture and a peripheral edge with bendable tangs;

d) a first plate having a large hole concentric about said central aperture in said cover plate, when said first plate is inserted into said cover plate;

e) a second plate having a tapered recessed circular portion with an orifice therethrough to said central aperture in said cover plate and said large hole in said first plate, when said second plate is inserted into said cover plate against said first plate, whereby said bendable tangs are bent over to retain said first plate and said second plate within said cover plate; wherein said attaching means includes:

f) a plurality of bolts, each having a round head and a threaded shaft;

g) said first plate having a plurality of cavities therein about said large hole;

h) said second plate having a plurality of large top slots, each in alignment with one said cavity in said first plate, so that each said round head of each said bolt can be inserted into one said large top slot in said second plate, to enter one said cavity in said first plate and slide into position therein to retain said plates in a laterally adjustable removable condition;

i) a plurality of washers, each to fit onto one said threaded shaft after said threaded shaft is inserted and extends through a bore hole in the door; and j) a plurality of nuts, each to thread onto each said threaded shaft; further including a raising bracket having a large central opening, a plurality of smaller holes therethrough, a pair of opposite recessed areas one of which is deeper than the other, so that said plate assembly can fit into either one of said recessed areas, with said large central opening in a general alignment with said central passageway in said plate assembly and said smaller holes in a general alignment with said threaded shafts of said bolts extending from said plate assembly, when the lock cylinder extends further outwardly from the door.

* * * * *